US007624708B2

(12) United States Patent
Butterlin et al.

(10) Patent No.: US 7,624,708 B2
(45) Date of Patent: Dec. 1, 2009

(54) PROCESS FOR OPERATING A CONTINUOUS STEAM GENERATOR

(75) Inventors: Axel Butterlin, Bayreuth (DE); Rudolf Kral, Stulln (DE); Frank Thomas, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 305 days.

(21) Appl. No.: 11/632,019

(22) PCT Filed: Jul. 6, 2005

(86) PCT No.: PCT/EP2005/053227

§ 371 (c)(1),
(2), (4) Date: Jan. 9, 2007

(87) PCT Pub. No.: WO2006/005708

PCT Pub. Date: Jan. 19, 2006

(65) Prior Publication Data

US 2008/0066695 A1 Mar. 20, 2008

(30) Foreign Application Priority Data

Jul. 9, 2004 (EP) ..... 04016248

(51) Int. Cl.
*F22B 37/42* (2006.01)

(52) U.S. Cl. ..... 122/448.1; 122/447; 60/775

(58) Field of Classification Search ..... 122/406.1, 122/406.3, 447, 448.1; 60/39.182, 736, 775
See application file for complete search history.

(56) References Cited

U.S. PATENT DOCUMENTS

| | | | | |
|---|---|---|---|---|
| 2,337,851 | A | 12/1943 | Junkins | |
| 3,196,844 | A | 7/1965 | Sulzer | |
| 3,774,396 | A | 11/1973 | Borsi et al. | |
| 3,828,738 | A * | 8/1974 | Frei | 122/504.2 |
| 3,914,795 | A * | 10/1975 | Alliston et al. | 376/217 |
| 4,074,360 | A * | 2/1978 | Stadie et al. | 701/99 |
| 5,529,021 | A * | 6/1996 | Butterlin et al. | 122/448.1 |
| 5,735,236 | A | 4/1998 | Kastner et al. | |
| 6,039,008 | A | 3/2000 | Anderson et al. | |
| 6,343,570 | B1 * | 2/2002 | Schmid et al. | 122/7 R |
| 6,427,637 | B1 | 8/2002 | Ineichen | |
| 6,497,737 | B1 | 12/2002 | Conochie et al. | |
| 2007/0204623 | A1 * | 9/2007 | Rollins, III | 60/772 |

FOREIGN PATENT DOCUMENTS

EP 0 639 253 B1 2/1995

(Continued)

*Primary Examiner*—Gregory A Wilson

(57) ABSTRACT

The invention relates to a process for operating a continuous steam generator. The aim of the invention is to provide, with little technical complexity and for any operating state, a synchronous variation of the feed-water mass flow passing through the evaporator heating surface and of the heat input into the evaporator heating surface. To this end, a regulating device for the discharge of feed-water is allocated to a device for adjusting the feed-water mass flow. The control variable of said regulating device is the feed-water mass flow, while its set-point value in relation to the feed-water mass flow depends on the set-point value associated to the power of the steam generator. The actual value of the feed-water density at the entry of the pre-heater is fed to the regulating device for the discharge of feed-water as one of the input values.

8 Claims, 5 Drawing Sheets

FOREIGN PATENT DOCUMENTS

| | | | |
|---|---|---|---|
| JP | 2002168408 | A | 2/2002 |
| TW | 392052 | B | 6/2000 |
| TW | 394835 | B | 6/2000 |
| TW | 413723 | B | 12/2000 |
| WO | 9322599 | A1 | 11/1993 |
| WO | 9918039 | A1 | 4/1999 |

* cited by examiner 1
2
3
4
5
6
7
9
10
11
12
13
14
14a
15
16
17
18
20
22
23
24
L
L1
$\dot{M}(L1)$
$\dot{Q}(L1)$
h(L1)
$h_{SA}(L2)$
$h_{IE}$
$\dot{M}_S$
$V_E^* = M_E$ 1
2
3
4
5
6
7
9
10
11
12
13
14
14a
15
16
17
18
20
21
22
23
24
26
28
30
32
34
36
L
$\dot{M}(L1)$
$\dot{Q}(L1)$
$h_{SA}(L2)$
$h_{IE}$
$\dot{M}_E$
$\dot{M}_A$
$\dot{M}$
$\dot{M}_S$
E
E

PROCESS FOR OPERATING A CONTINUOUS STEAM GENERATOR

CROSS REFERENCE TO RELATED APPLICATIONS

This application is the US National Stage of International Application No. PCT/EP2005/053227, filed Jul. 6, 2005 and claims the benefit thereof. The International Application claims the benefits of European Patent application No. 04016248.9 filed Jul. 9, 2004. All of the applications are incorporated by reference herein in their entirety.

FIELD OF INVENTION

The invention relates to a process for operating a continuous steam generator with an evaporator heating surface as well as a preheater connected upstream of the evaporator and a device for adjusting the feed-water mass flow $\dot{M}$ into the evaporator heating surface.

BACKGROUND OF THE INVENTION

In a continuous steam generator the heating of a number of steam generator tubes which together form the gas-tight enclosing wall of the combustion chamber leads to a complete evaporation of a flow medium in the steam generator tubes in one operation. The flow medium—usually water—is fed before its vaporization to a preheater, usually referred to as an economizer, connected upstream from the evaporator heating surface and preheated there.

The feed-water mass flow into the evaporator heating surface is regulated as a function of the operating state of the continuous steam generator and correlated to this as a function of the current steam generator performance. With changes in load the evaporator throughflow and the heat entry into the continuous evaporator heating surface are to be changed as synchronously as possible, since otherwise a fishtailing of the specific enthalpy of the flow medium at the output of the evaporator heating surface cannot securely be avoided. Such an undesired fishtailing of the specific enthalpy makes it more difficult to control the temperature of the fresh steam emerging from the steam generator and additionally leads to high material stresses and thereby to a reduced lifetime of the steam generator.

To avoid a fishtail effect of the specific enthalpy and large temperature variations in each operating state of the steam generator a feed-water throughflow regulation is provided which, even if the load changes, provides the necessary feed-water setpoint values depending on the operating state.

A continuous steam generator is known from EP 0639 253 in which the feed-water throughflow is regulated using an advance calculation of the feed-water volume. The basis used for calculation in this case is the heat flow balance of the evaporator heating surface, in which the feed-water mass flow, especially at the entry of the evaporator heating surface, should be included.

In practice however the measurement of the feed-water mass flow directly at the entry of the evaporator heating surface proves to be technically complex and not able to be performed reliably in every technical operating state. Instead the feed-water mass flow at the entry to the preheater is measured as an alternative and is included in the calculations of the feed-water mass flow, but this is not the same in every case as the feed-water mass flow at the entry of the evaporator heating surface.

If the temperature of the medium flowing into the preheater or as a result of a changed heating of the density of the flow medium within the preheater changes, this results in mass injection or extraction effects in the preheater and the feed-water mass flow at the entry of the preheater is not identical to that at the entry of the evaporator heating surface. If these injection and extraction effects are not taken into account or are only insufficiently taken into account in the regulation of the feed-water throughflow, the fishtail effects of the specific enthalpy mentioned can occur and the result can be large variations in the temperature of the flow medium at the exit of the evaporator heating surface.

In this case the size of the variations in temperature is dependent on the speed at which the load changes and is particularly large with a fast load change. Therefore it was previously necessary to limit the speed at which the load changed and thereby accept a lower efficiency of the steam generator. In addition the rapid and uncontrollable change in load occurring as a result of possible operating faults reduced the lifetime of the steam generator.

BACKGROUND OF THE INVENTION

The object of the invention is thus to specify a method for operating a steam generator of the type mentioned above which allows a largely synchronous change of the feed-water mass flow through the evaporator heating surface and of the heat entry into the evaporator heating surface in any operating state without major technical outlay.

In accordance with the invention this object is achieved by the device for adjusting the feed-water mass flow $\dot{M}$ being assigned a regulating device of which $\dot{M}$ is the regulation variable of the feed-water mass flow and of which the setpoint value $\dot{M}s$ for feed-water mass flow is maintained depending on a setpoint value L assigned to the steam generator performance., with the regulating device being fed the actual value $p_E$ of the feed-water density at the entry of the preheater as one of the input values.

In this case the invention is based on the idea that, for synchronous change of the feed-water mass flow through and entry of heat into the evaporator heating surface, a heat flow balancing of the evaporator heating surface should be undertaken. Optimally a measurement of the feed-water mass flow should be provided to this end at the entry of the evaporator heating surface. Since however the direct measurement of the feed-water mass flow at the entry of the evaporator heating surface has proved not to be reliable to perform, this measurement is now provided at a suitable upstream point on a medium side, namely at the entry to the preheater. Since the possible mass injection and extraction effects which might occur in the preheater could falsify the measured value however, these effects should be suitably compensated for. To this end a calculation of the feed-water mass flow at the entry of the evaporator heating surface should be undertaken on the basis of further easily-obtainable measured values. Especially suitable measurement variables for correcting the measured value obtained at the entry of the preheater for the feed-water mass flow are the average density of the flow medium into the evaporator heating the surface and the way in which it changes over time.

For an especially precise calculation of the heat flow through the evaporator heating surface and also an especially precise correction adjustment of the measured value for the feed-water mass flow the additional recording of the density of the flow medium at the exit of the preheater heating surface is additionally provided. Thus an especially precise recording and as a consequence also the ability to take account of the injection and extraction effects mentioned is made possible. In an additional or alternative advantageous further development the expression $\dot{M}+\Delta\bar{p}\cdot V$ is used as the setpoint value $\dot{M}s$ for the feed-water mass flow, with $\dot{M}$ being the actual value of the feed-water mass flow at the entry of the preheater, $\Delta\bar{p}$ being the change over time of the average density of the flow medium in the preheater and V being the volume of the preheater. Thus the element $\Delta\bar{p}\cdot V$ is used to take account of the said injection and extraction effects.

If the entry of heat into the flow medium within the preheater is stationary, i.e. does not change over time, then, to calculate setpoint value $\dot{M}s$ instead of the average density $\bar{p}$ approximately the density $p_E$ of the flow medium at the entry of the preheater is used. In this case the change over time of the density $p_E$ can be set to be the same as the change over time of the average density $\bar{p}$ so that the additional recording of the density $p_A$ of the flow medium at the exit of the evaporator heating surface is not required.

To calculate the setpoint value $\dot{M}s$ for the feed-water mass flow account should be taken of the fact that the signal of the entry density change must be delayed in accordance with the throughflow time of the system if instead of the average density $\bar{p}$ approximately the density $p_E$ of the flow medium at the entry of the preheater is to be used. Thus the actual value $p_E$ of the entry density is advantageously converted by a differentiating element usually present in regulation technology with PT1 behavior into an entry density change delayed by the throughflow time of the preheater as time constant.

Especially in the case of a heating change in the preheater however, that is of a non-stationary heat entry into the flow medium within the preheater, for example with a change of load, the calculation of the average density $\bar{p}$ and its change over time $\Delta\bar{p}$ is not possible solely through the approximated use of the entry density. Since half of $p_E$ and $p_A$ are included in the arithmetic mean in the calculation of $\bar{p}$ in each case, in the case of a non-stationary heat entry, but a constant entry density $p_E$ the half change of the output density $p_A$ can be used as a measure for the change of density in the preheater.

In this case too the timing of the density signal is derived by a differentiating element. Since a change of the exit density however follows on in time from the mass storage effect in the preheater, the density signal is advantageously PT1-delayed by a comparatively small time constant of around one second.

With a separate recording of the densities of the flow medium at the entry and the exit of the preheater, feed-water injection and extraction effects can be taken into account in this manner in the preheater and the setpoint value of the feed-water throughflow can be adapted in a simple manner to the operating status of the steam generator.

This makes possible an especially precise regulation of the steam generator even in cases in which the temperature of the feed-water changes abruptly before entering the preheater. This could for example occur as a result of the sudden failure of an external preheating path upstream from the preheater. With this type of failure the jump in the density of the flow medium at the entry of the preheater largely continues unchanged up to the exit. The change in the average density $\bar{p}$ of the flow medium in the preheater has however already been completely recorded by the change of the density at the entry to the preheater so that the change of density at the exit of the evaporator heating surface may no longer have an effect on the calculated correction to the setpoint value $\dot{M}s$ of the feed-water mass flow. Thus a correction circuit s preferably provided which compensates for the reaction of the DT1 element which differentiates the density signal at the output of the preheater and delays it, in this case compensates for it. To do this the entry density signal is advantageously switched into a lag element with a time constant of the throughflow of the preheater, delayed in accordance with a thermal time constant PT1 of the preheater and the signal generated in this way will be switched negatively into in the output density signal.

This correction circuit causes the changes in density to be correctly taken into account in any event: With an abrupt temperature change of the inflowing medium the change in the exit density $p_A$ is, as described, not taken into account. If however the entry density $p_E$ remains constant but the heat feed in the preheater and thereby the exit density $p_A$ changes, there is no correction undertaken at the exit of the preheater and the effect of the change of the heat feed is taken into account fully in the calculation of the setpoint value $\dot{M}s$ for the feed-water mass flow.

If, when there is a change in the load for example, the entry density $p_E$ now also changes at the same time as the supply of heat, both mass injection and extraction effects caused by the jump in density at the entry and also storage affects as a result of the change in the heat supply are taken into account separately. For correction at the exit of the preheater only changes arising as a result of the changed heat supply are taken into account since the changes caused by the jump in density which occur delayed at the entry and also at the exit are only taken into account at the entry and compensated for at the exit.

Advantageously both the lag and also the thermal time constant of the preheater will be adapted reciprocally to the load of the steam generator.

Advantageously the feed-water throughflow regulation can be switched on and switched off depending on the operating state of the steam generator.

The benefits obtained by the invention lie in particular in the fact that, by calculating the feed-water mass flow taking into account the average density of the feed water in the preheater as the correction term, synchronous regulation of the feed-water throughflow through and the heat entry into the evaporator heat surface prevents in an especially simple and reliable manner in all possible operating states of the continuous steam generator fishtailing of the specific enthalpy of the flow medium at the exit of the evaporator heat surface and large temperature variations of the fresh steam generated and thus reduces stresses on materials and increases the lifetime of the steam generator.

BRIEF DESCRIPTION OF THE DRAWING

Exemplary embodiments of the invention are explained in greater detail with reference to a drawing. The Figures show.

The same parts are shown by the same reference symbols in all the Figures.

DETAILED DESCRIPTION OF INVENTION

Figure 1:
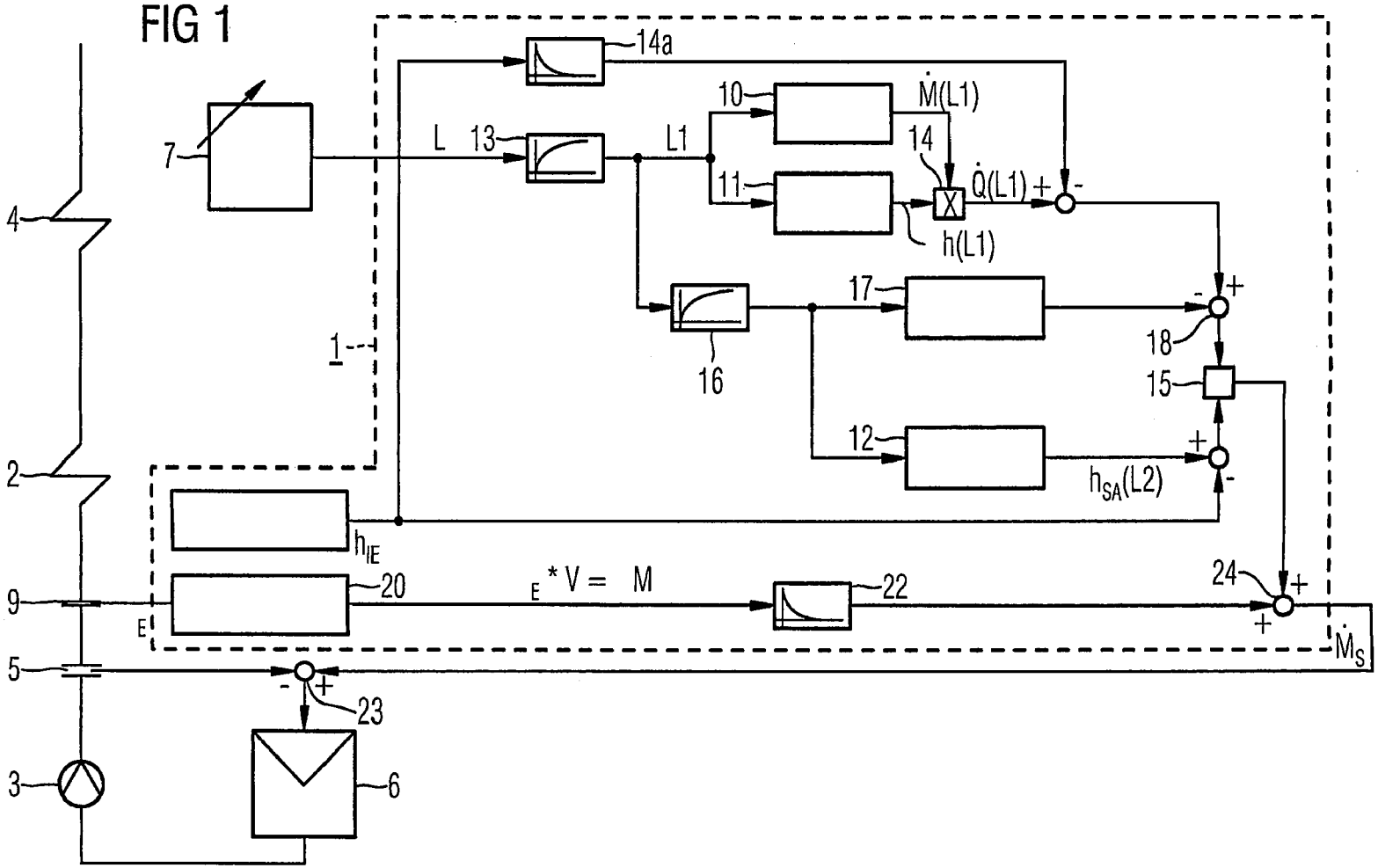
FIG. 1 a feed-water throughflow regulation for a continuous steam generator, FIG. 2 an alternative embodiment of the feed-water throughflow regulation, FIG. 3*a* a diagram with timing curve of the specific enthalpy of the flow medium at the exit of the evaporator heat surface of the continuous steam generator in the event of an abrupt temperature change of the inflowing feed water during full-load operation of the continuous steam generator, FIG. 3*b* a diagram with the timing curve of the specific enthalpy in the case of an abrupt change in temperature of the inflowing medium in part-load operation of the continuous stream generator, and FIG. 3*c* a diagram with the timing curve of the specific enthalpy in the case of a change in load.

FIG. 1 shows schematically a device 1 for forming the setpoint value $\dot{M}s$ for the feed-water mass flow of a continuous steam generator. The continuous steam generator also features a preheater 2 for feed water, referred to as an economizer, which is located in a gas path not shown in greater detail. On the flow medium side a feed-water pump 3 is connected upstream and an evaporator heating surface 4 downstream of the preheater. A measurement device 5 for measurement of the feed-water mass flow $\dot{M}$ through the feed-water line is arranged in the feed-water line routed from the feed-water pump 3 to the preheater 2.

A controller 6 is assigned to a drive motor at the feed-water pump 3, at the input of which lies the control deviation $\Delta\dot{M}$ of the feed-water mass flow $\dot{M}$ measured with the measurement device 5. The device 1 for forming of the setpoint value $\dot{M}s$ for the feed-water mass flow is assigned to the controller 6.

This device is especially designed for on-demand determination of the setpoint value $\dot{M}s$. This takes into account the fact that recording the actual value of the feed-water mass flow $\dot{M}$ is not undertaken directly before the evaporator heating surface 4, but before the preheater 2. This means that as a result of mass injection or extraction effects in the preheater 2 inaccuracies in the measured value determination for the feed-water mass flow $\dot{M}$ could be produced. To compensate for this a correction of this measured value. Taking into account the density $p_E$ of the feed water at the entry of the preheater 2 is provided. The device 1 includes as its input variables on the one hand a setpoint value L issued by a setpoint value generator 7 for the performance of the continuous steam generator and on the other hand the actual value $p_E$ of the density of the feed water at the entry of the preheater 2 determined from the pressure and temperature measurement of a measuring device 9.

The setpoint value L for the performance of the continuous steam generator which repeatedly changes during operation and which is specified directly in the firing control circuit (not shown) to the fuel regulator, is also fed to the input of a first delay element 13 of the device 1. This delay element 13 issues a first signal or a delayed first performance value L1. This first performance value L1 is fed to the inputs of the function generator units 10 and 11 of the function generator of the feed-water throughflow regulator 1. At the output of the function generator unit 10 there appears a value $\dot{M}$ (L1) for the feed-water mass flow, and at the output of the function generator unit 11 appears a value $\Delta h$(L1) for the difference between the specific enthalpy $h_{IA}$ at the exit of the evaporator heating surface 4 and the specific enthalpy $h_{IE}$ at the entry of this evaporator heating surface 4. The values $\dot{M}$ and $\Delta h$ as functions of L1 are determined from values for $\dot{M}$ and $\Delta h$, which were measured in stationary operation of the continuous steam generator and in the function generator units 10 or 11.

The output variables $\dot{M}$ (L1) and $\Delta h$(L1) are multiplied together in a multiplication element 14 of the function generator of the device 1. The product value $\dot{Q}$ (L1) obtained corresponds to the heat flow into the evaporator heating surface 4 for performance value L1 and, where necessary after correction by a performance factor determined in a differentiating element 14*a* from the entry enthalpy, characteristic for injection and extraction effects in the steam generator, is entered as a counter into a divider element 15. As the denominator the difference formed with a summation element between a setpoint value $h_{SA}$ (L2) of the specific enthalpy at the exit of the evaporator heating surface 4 and the actual value $h_{IE}$ of the specific enthalpy at the entry of the evaporator heating surface which is measured with the aid of measuring device 9, is entered into the divider element 15.

The setpoint value $h_{SA}$ (L2) is taken from a third function generator unit 12 of the function generator of device 1. The input value of the function generator unit 12 is produced at the output of a second delay element 16, of which the input variable is the first performance value L1 at the output of the first delay element 13. Accordingly the input value of the third function generator unit 12 is a second performance value L2, which is delayed in relation to the first performance value L1. The values $h_{SA}$ (L2) as a function of L2 are determined from values for $h_{SA}$ which were measured in stationary operation of the continuous steam generator, and stored in the third function generator unit 12.

The setpoint value $\dot{M}s$ for the feed-water mass flow for the formation of the regulation deviation fed to the controller 6 of the actual value measured with the device 5 for the feed-water mass flow in the preheater 2 taking place in a summation element 23 can be taken from the output of the divider element 15.

At the output of the second delay element 16 lies the input of a differentiation element 17, of which the output is switched negatively to a summation element 18. This summation element 18 corrects the value for the heat flow $\dot{Q}$ (L1) in the evaporator heating surface 4 by the output signal of the differentiation element 17.

The actual values of temperature and pressure of the feed water at the entry of the preheater 2 measured by the measurement device 9 are converted in a computing element 20 into an actual value $p_E$ of the feed-water density at the entry of the preheater 2. This is passed to the input of a differentiation element 22 and is multiplied by the volume of the preheater. The approximate value $\Delta\dot{M}$ thus calculated for the change of the feed-water mass flow as a result of injection and extraction effects within the preheater 2 is fed via a delay element integrated into the differentiation element 22, with the throughput time of the feed water through the preheater 2 as time constant, to a summation element 24, which corrects the setpoint value for the mass flow $\dot{M}s$ from the differentiating element 15 by $\Delta\dot{M}$ and thus makes it possible to take account of mass injection and extraction effects as a result of a change of the temperature and thus the density of the feed water at the entry of the preheater 2 in the regulation of the feed-water mass flow.

Figure 2:
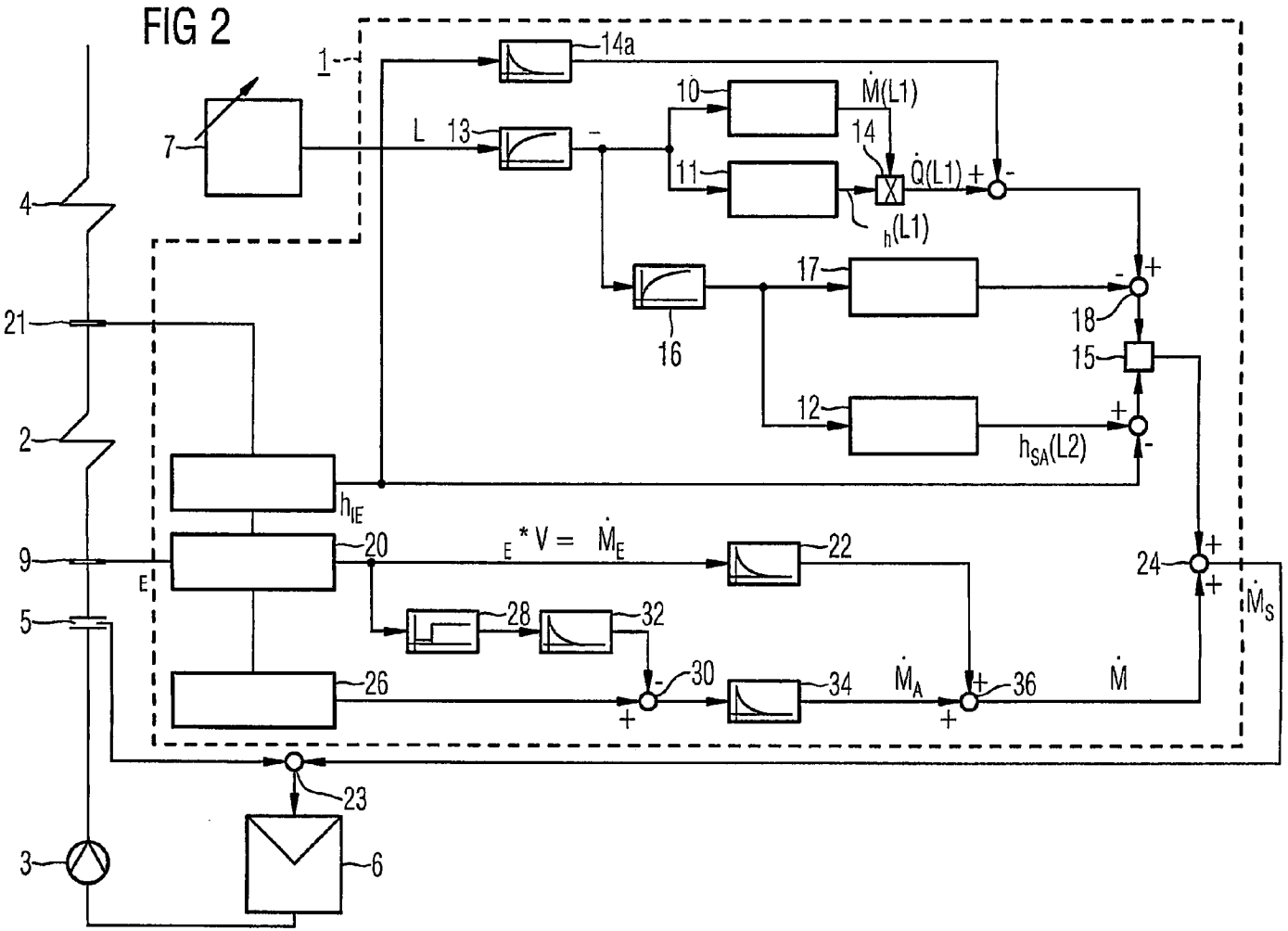

FIG. 2 shows an alternative embodiment of the feed-water throughflow regulation which also allows mass injection and extraction effects in the regulation of the feed-water mass flow to be reliably taken into consideration even in the case of the heat entry into the preheater 2 changing over time.

To this end the feed-water throughflow regulation in accordance with FIG. 1 is expanded in the exemplary embodiment according to FIG. 2 to take account of the density $p_A$ of the flow medium at the exit of the preheater 2. To determine the density of the flow medium at the exit of the preheater 2 a measuring device 21 for measuring the pressure and the temperature of the flow medium is provided at the exit of the preheater 2. The calculation element 26 determines the actual value of the density $p_A$ of the flow medium at the exit of the preheater 2 as input signal for a downstream summation element 30 from the measurement of temperature and pressure. The output signal of the summation element 30 is fed to a differentiation element 36 which delivers its time derivation multiplied by the volume of the preheater 2 as output signal. This output signal, which reflects the change over time of the feed-water mass flow $\Delta\dot{M}_A$ at the exit of the preheater 2, is applied to a summation element 36 which, as its second input variable has the change $\Delta\dot{M}_E$ of the feed-water mass flow at the entry of the preheater 2.

The summation element 36 has as its output signal the average change of the feed-water mass flow $\Delta\dot{M}$ as a result of mass injection and extraction effects in the preheater 2 calculated from $\Delta\dot{M}_A$ and $\Delta\dot{M}_E$. The output signal of the divider element 36 is connected at the summation element 24 to the output signal of the divider element 15 for correction of the setpoint value of the feed-water mass flow.

In the event of an operating fault which leads to an abrupt change in temperature of the feed water flowing into the preheater 2, for example on sudden failure of an upstream preheating path, the output signal of the calculating element 26 must also be corrected by the effect of the changed input density. If this is not done, the effect of the jump in density at the entry of the preheater 2 is taken into account twice, that is during recording of the density of the feed water at the entry and at the exit of the preheater 2. To correct this, the output signal of the differentiating element 20 is connected to a lag element 28 with the throughput time of the feed water through the preheater 2 as time constant. The signal thus generated is connected negatively via a delay element 32 with a thermal memory constant of the preheater 2 to the summation element 30. Thus the effect of the jump in density at the entry of the preheater 2 is eliminated in the exit density signal and thereby only considered once and not twice in the calculation of the correction mass flow.

The feed-water throughflow regulation using device 1 enables the setpoint value $\dot{M}s$ for the feed-water mass flow through the evaporator heating surface 4 to be determined in each operating state of the steam generator in an especially simple manner. By precisely balancing this feed-water mass flow to the heat entry into the evaporator heating surface large fluctuations of the exit temperature of the fresh steam and a fishtailing of the specific enthalpy at the exit of the evaporator heating surface 4 can be safely prevented. High material stresses caused by temperature fluctuations which lead to a reduced lifetime of the continuous steam generator can thus be avoided.

Figure 3A:
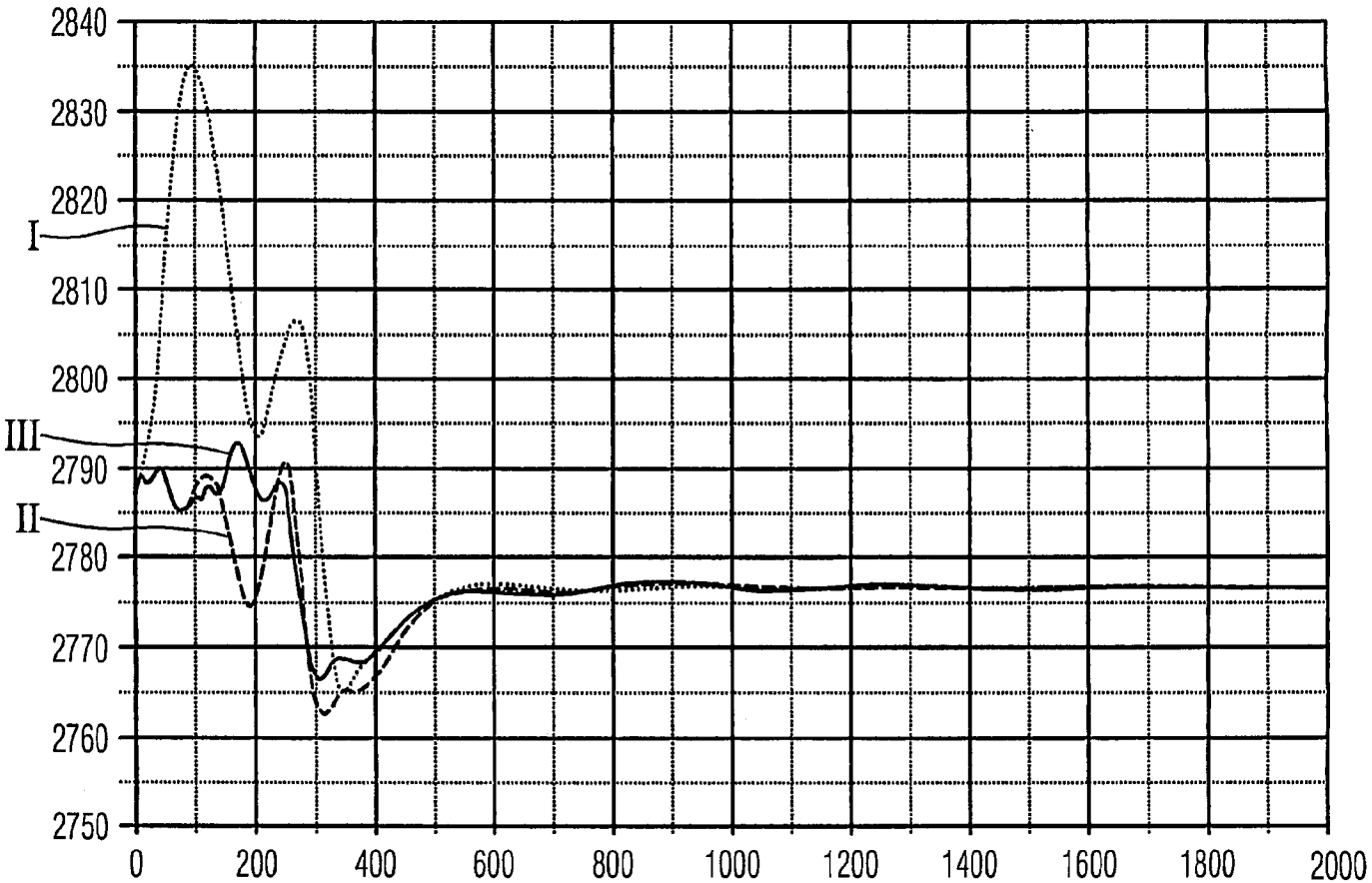

The graph shown in FIG. 3*a* (curves I to III) of the three specific enthalpies in kJ/kg at the exit of the evaporator heating surface 4 as a function of the time t has been determined for a continuous steam generator in full-load operation for a failure of a preheating path connected upstream from the preheater 2. Curve I in FIG. 3*a* applies in the case, where a change in density of the feed water at the entry of the preheater 2 caused by the simulated operating fault is not taken into account in the feed-water throughflow regulation, where the uncorrected output signal of the divider element 15 according to FIG. 1 or 2 is thus used as the required value $\dot{M}s$ for the feed-water mass flow.

Curve II then applies in the case in which, as is only shown in FIG. 1, the timing change of the density $p_E$ at the entry of the preheater 2 and thereby only the mass injection and extraction effects as a result of the temperature jump at the entry of the preheater 2 are taken into account in the feed-water throughflow regulation. Mass injection and extraction effects as a result of changed heating in the preheater 2 and thereby of a changed heat entry into the feed water remain unconsidered. This case corresponds to the feed-water throughflow regulation shown in FIG. 1.

Finally curve III shows the timing of the specific enthalpy additionally taking account of the mass injection and extraction effects as a result of a changed heating in the preheater 2, which corresponds to the feed-water throughflow regulation from FIG. 2. In this case the summation element 24 from FIG. 2 has as its second input variable, as well as the initial variable of the differentiating element 15, the average change of the feed-water mass flow $\Delta\dot{M}$ calculated from $\Delta\dot{M}_A$ and $\Delta\dot{M}_E$. The feed-water mass flow regulation also takes into account in this case not only the density $p_E$ at the entry of the preheater 2, but also the density $p_A$ at its exit By separately recording the two densities $p_E$ and $p_A$, mass injection and extraction effects both as a result of changed heating in the preheater 2 and also as a result of a changed temperature of the feed water at the entry of the preheater 2 can be taken into account.

Figure 3B:
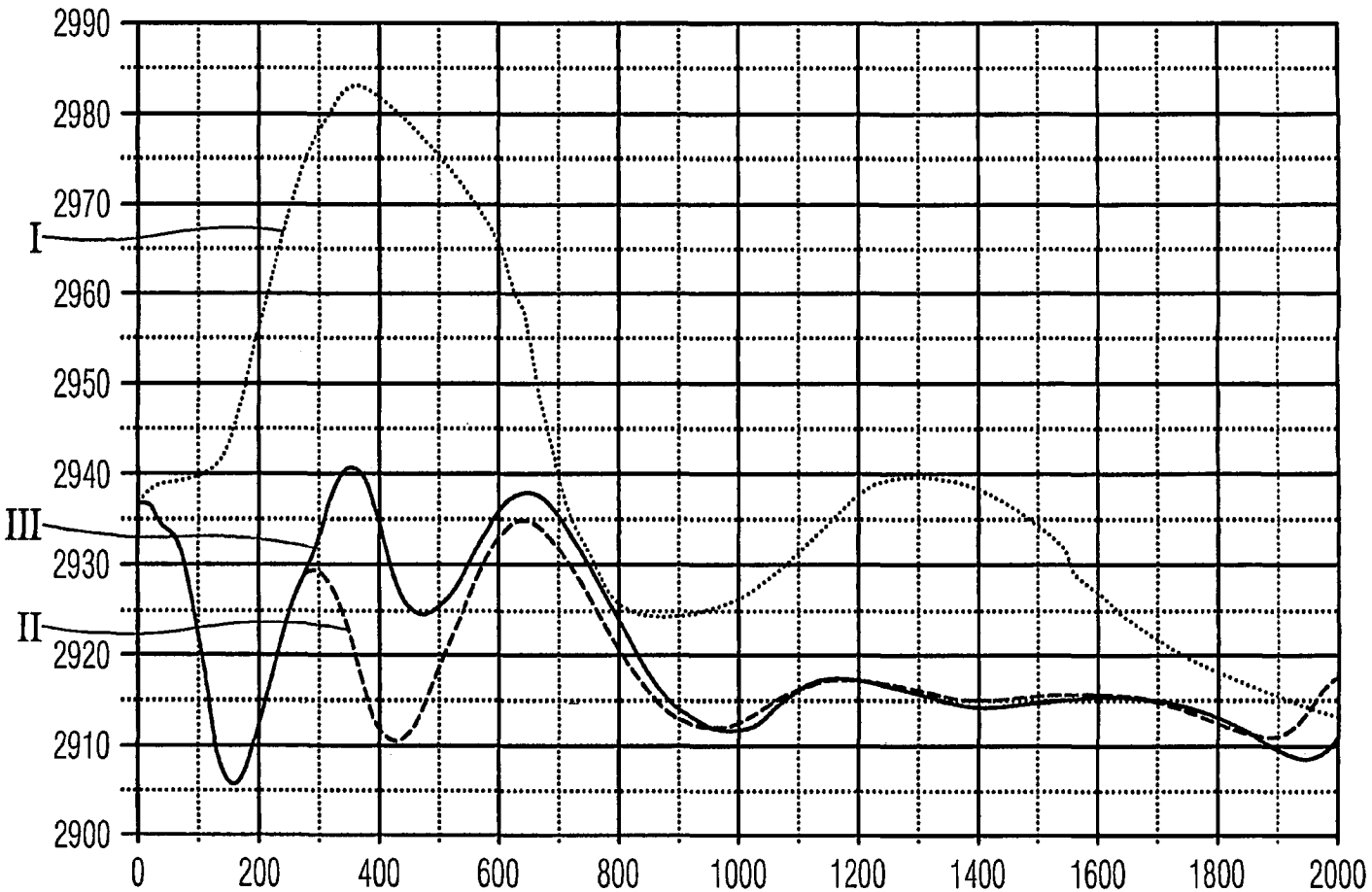

FIG. 3*b* shows the graph (curves I to III) of the three specific enthalpies in kJ/kg at the exit of the evaporator heating surface 4 as a function of the time t for a continuous steam generator in part-load operation (50% of maximum power) on failure of a preheating path upstream from the preheater 2.

Curve I in FIG. 3*b* applies as in FIG. 3*a* to the case in which a change in the density of feed water at the entry of the preheater 2 caused by the failure of the preheating path connected upstream from the preheater 2 is not taken into account in feed-water throughflow regulation, in which the uncorrected output signal of the divider element 15 according to FIG. 1 or 2 is thus used as the setpoint value $\dot{M}s$ for the feed-water mass flow.

Curve II in FIG. 3*b* applies as in FIG. 3*a* to the case in which, as is merely shown in FIG. 1, the change over time of the density $p_E$ at the entry of the preheater 2 is taken into account for feed-water throughflow regulation. Mass injection and extraction effects as a result of changed heating in the preheater 2 remain unconsidered. This case corresponds to the feed-water throughflow regulation shown in FIG. 1.

Curve III in FIG. 3*b* shows, as in FIG. 3*a*, the timing of the specific enthalpy taking additional account of the mass injection and extraction effects as a result of a changed heating in the preheater 2, which corresponds to the feed-water throughflow regulation from FIG. 2.

Figure 3C:
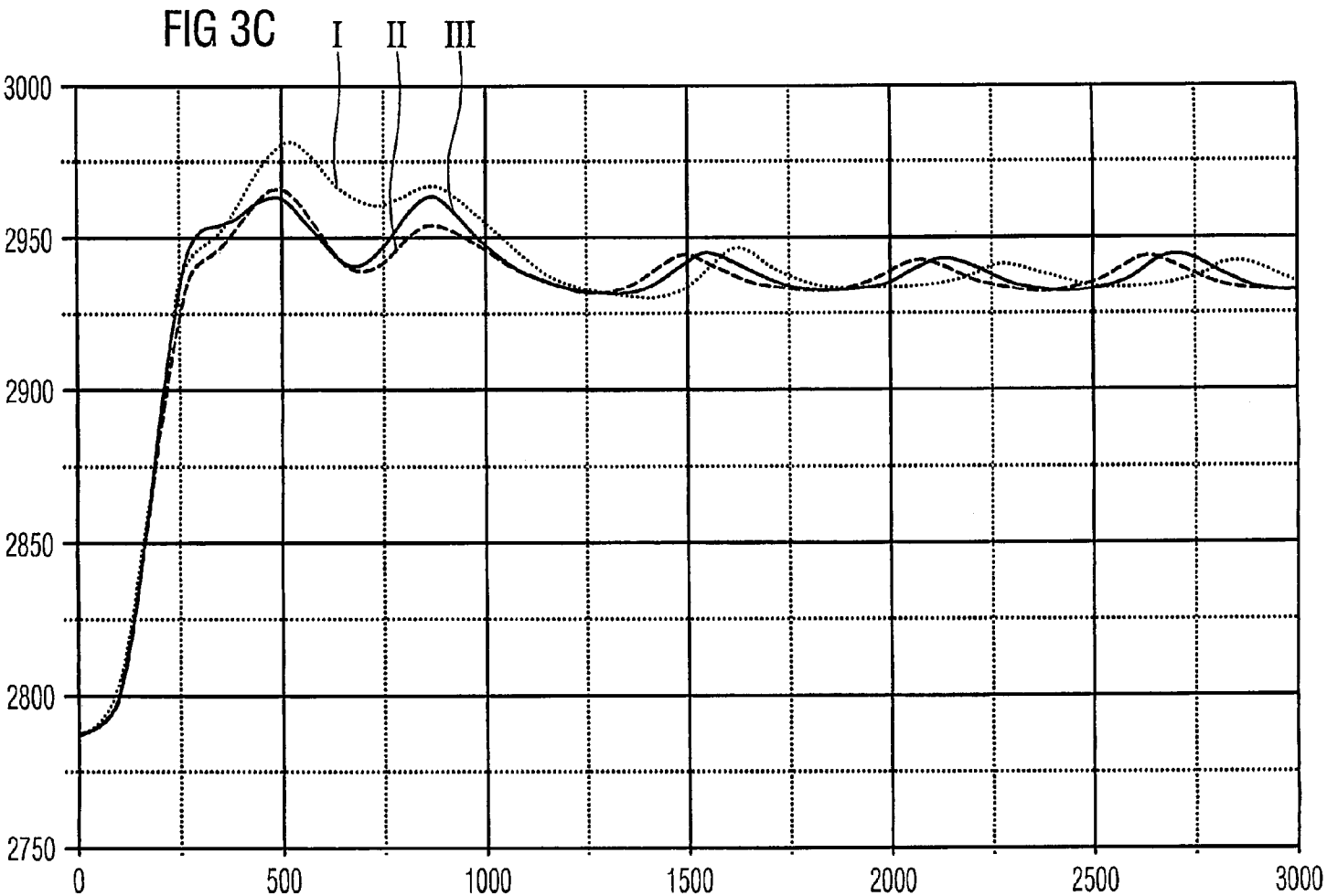

FIG. 3*c* shows the graph (curves I to III) of the three specific enthalpies in kJ/kg at the exit of the evaporator heating surface 4 as a function of the time t for a continuous steam generator for a change in load from full-load to part-load operation (100% to 50% load).

Curve I in FIG. 3*c* applies, as in FIG. 3*a*, to the case in which a change in the density of feed water at the entry of the preheater 2 caused by the failure of preheater 2 is not taken into account in feed-water throughflow regulation, in which the uncorrected output signal of the divider element 15 according to FIG. 1 or 2 is thus used as the setpoint value $\dot{M}s$ for the feed-water mass flow.

Curve II in FIG. 3*c* applies, as in FIG. 3*a*, to the case in which, as is merely shown in FIG. 1, the change over time of the density $p_E$ at the entry of the preheater 2 is taken into account for feed-water throughflow regulation. Mass injection and extraction effects as a result of changed heating in the preheater 2 remain unconsidered. This case corresponds to the feed-water throughflow regulation shown in FIG. 1.

Curve III in FIG. 3*c* shows, as in FIG. 3*a*, the timing of the specific enthalpy taking additional account of the mass injection and extraction effects as a result of a changed heating in the preheater 2, which corresponds to the feed-water throughflow regulation from FIG. 2.

The diagrams depicted in FIGS. 3*a*, 3*b* and 3*c* show that the feed-water throughflow regulation 1 from FIG. 1 or 2 is especially suitable for avoiding a fishtailing of the specific enthalpy at the exit of the evaporator heating surface 4.

The invention claimed is:

1. A method for operating a continuous steam generator with an evaporator heating surface, comprising:

connecting a pre-heater upstream of the evaporator heating surface;

providing an adjusting device for adjusting a feed-water mass flow in the evaporator heating surface;

assigning a feed-water through-flow regulation to the adjusting device where a control value is the feed-water mass flow and a set-point value for the feed-water mass flow is maintained as a function of a steam generator performance; and providing an actual value of a feed-water density at the entry of the pre-heater as an input value to the feed-water through-flow regulation.

2. The process m accordance with claim 1, further comprising providing an actual value of the feed-water density at an exit of the pre-heater to the feed-water through-flow regulation as an additional input variable.

3. The process in accordance with claim 2, wherein the feed water set point value is defined as:

$$\dot{M}+\Delta\bar{p}\cdot V$$

where:

$\dot{M}$ is an actual value of the feed-water mass flow at the entry of the pre-heater, $\Delta\bar{p}$ is a change over time of an average density of the feed water within the pre-heater, and V is a volume of the pre-heater.

4. The process m accordance with claim 3, wherein a value for the average density of the feed water at the entry of the pre-heater is approximated by the actual value of the density of the feed water at the entry of the pre-heater.

5. The process in accordance with claim 4, wherein a change to the average density of the feed water in the pre-heater over a duration of time is formed by a functional element with a differentiating behavior.

6. The process in accordance with claim 5, wherein a signal corresponding to the actual value of the feed-water density at the entry of the pre-heater is switched to a lag element with a time constant of the throughput time of the pre-heater, delayed according to a thermal time constant of the pre-heater and the switched signal is connected negatively to a signal corresponding to the feed-water density at the exit of the pre-heater.

7. The process in accordance with claim 6, wherein a lag time and the thermal time constant of the pre-heater are adapted reciprocally to a load of the steam generator.

8. The process in accordance with claim 7, wherein the feed-water through-flow regulation is switched on and off as required.

* * * * *